US011035584B1

(12) United States Patent
Peronne, Jr.

(10) Patent No.: US 11,035,584 B1
(45) Date of Patent: Jun. 15, 2021

(54) EFFICENT AIR CONDITIONING SYSTEM

(71) Applicant: Thomas A. Peronne, Jr., Arlington, TX (US)

(72) Inventor: Thomas A. Peronne, Jr., Arlington, TX (US)

( * ) Notice: Subject to any disclaimer, the term of this patent is extended or adjusted under 35 U.S.C. 154(b) by 49 days.

(21) Appl. No.: 16/388,386

(22) Filed: Apr. 18, 2019

Related U.S. Application Data

(60) Provisional application No. 62/659,396, filed on Apr. 18, 2018.

(51) Int. Cl.

| | |
|---|---|
| ***F24F 11/30*** | (2018.01) |
| ***F25B 41/20*** | (2021.01) |
| ***F25B 41/31*** | (2021.01) |
| *F25B 29/00* | (2006.01) |
| *F25B 49/02* | (2006.01) |

(52) U.S. Cl.
CPC ..... *F24F 11/30* (2018.01); *F25B 41/20* (2021.01); *F25B 41/31* (2021.01); *F25B 29/003* (2013.01); *F25B 49/02* (2013.01); *F25B 2341/06* (2013.01)

(58) Field of Classification Search
CPC ..... F24F 11/30; F25B 41/04; F25B 41/062; F25B 2341/06; F25B 49/02; F25B 29/003
See application file for complete search history.

(56) References Cited

U.S. PATENT DOCUMENTS

| | | | | |
|---|---|---|---|---|
| 4,599,873 A * | 7/1986 | Hyde | ..... | F25B 1/00 62/118 |
| 6,327,871 B1 * | 12/2001 | Rafalovich | ..... | F25B 5/04 62/267 |
| 2013/0145791 A1 * | 6/2013 | Christensen | ..... | F25B 9/008 62/498 |

* cited by examiner

*Primary Examiner* — Larry L Furdge
(74) *Attorney, Agent, or Firm* — Richard Eldredge; Leavitt Eldredge Law Firm

(57) ABSTRACT

An efficient air conditioning system absorbs heat via a fluid, such as a refrigerant, from one place in the cycle and rejects the heat from the fluid in another place in the cycle. A receiver or storage tank is arranged between the condenser and the first heat exchanger to ensure a constant and steady flow of fluid to the heat exchanger. A dual heat exchanger system and additional expansion valve provide sub-cooling of the liquid refrigerant exiting the condenser.

2 Claims, 3 Drawing Sheets

EFFICENT AIR CONDITIONING SYSTEM

BACKGROUND

1. Field of the Invention

The present invention relates generally to an air conditioning system for the removal of heat to control the climate in a building or other enclosed space.

2. Description of Related Art

Air conditioning systems are well known in the art and are effective means to move heat from an indoor, enclosed space to the outside. For example, FIG. 1 depicts a conventional air conditioning system 101 having a compressor 103, condenser 105 and evaporator 107 arranged in a cycle using a fluid such as refrigerant that passes through each to move heat from one space (where the evaporator is located) to another (where the condenser is located).

One of the problems commonly associated with system 101 is its limited efficiency. For example, on hot days, higher temperature and enthalpy of the refrigerant exiting the condenser limits the ability of the evaporator to absorb heat during the next portion of the cycle.

Accordingly, although great strides have been made in the area of air conditioning systems, many shortcomings remain in the quest to improve efficiency.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
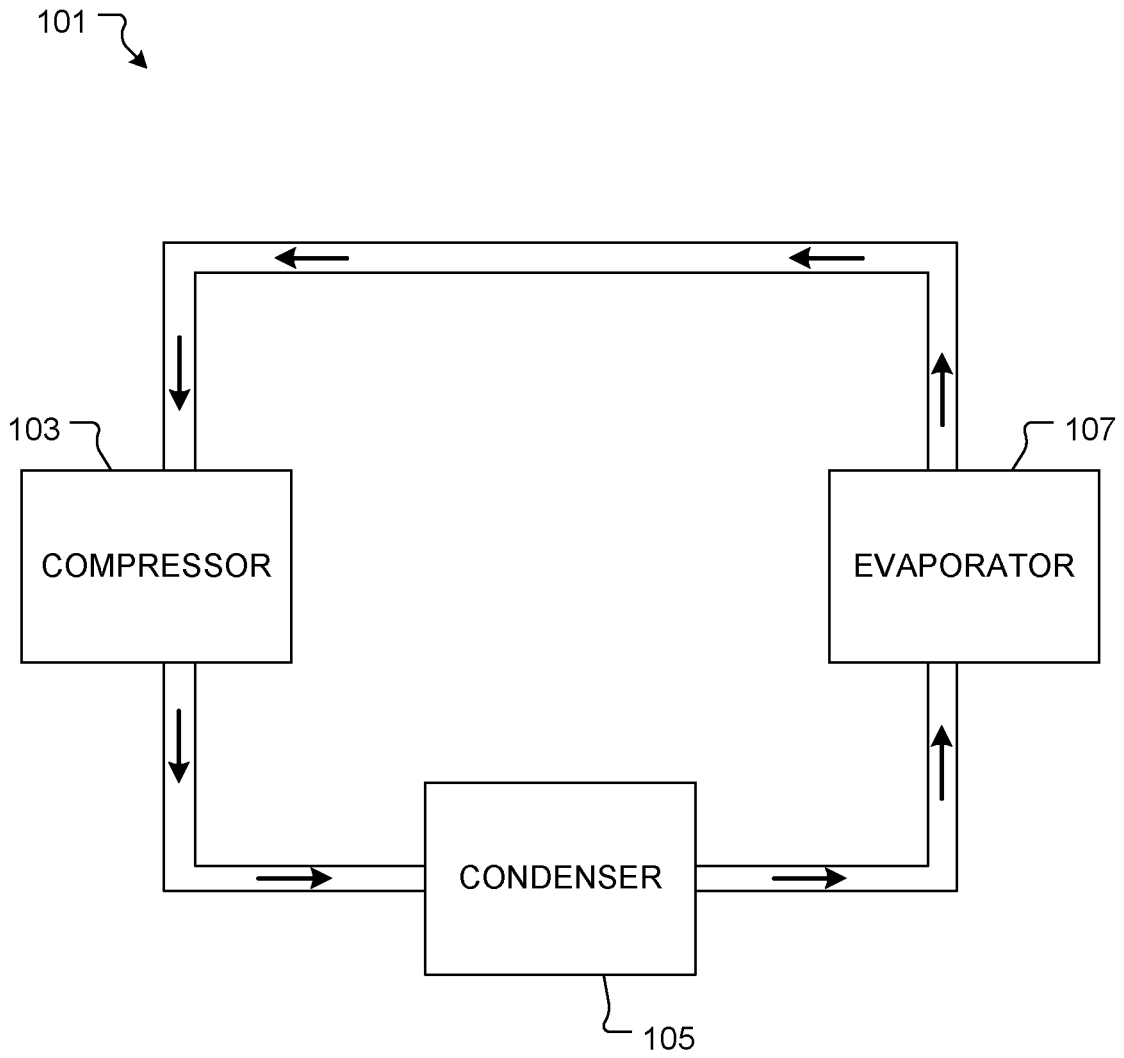
FIG. 1 Prior Art
FIG. 1 is a diagram of a common air conditioning system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional air conditioning systems. Specifically, the invention of the present application sub-cools the liquid refrigerant (without requiring another compressor) before it enters the evaporator to reduce the temperature and enthalpy and leave more ability to absorb heat from the enclosed area through the evaporator. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
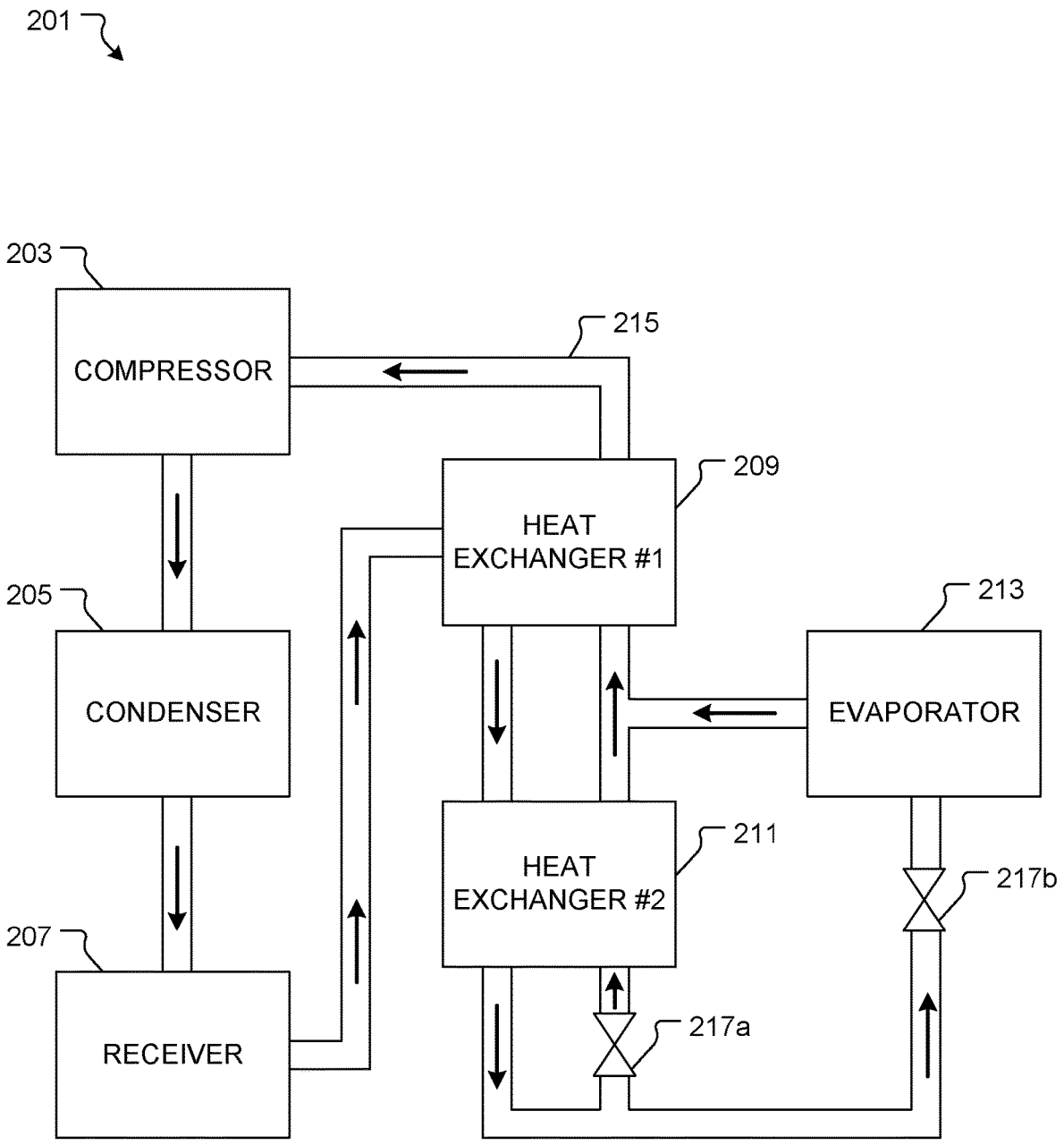
FIG. 2 is a diagram of an efficient air conditioning system in accordance with a preferred embodiment of the present application.

Referring now to the drawings wherein like reference characters identify corresponding or similar elements throughout the several views, FIG. 2 depicts a diagram of an efficient air conditioning system in accordance with a preferred embodiment of the present application. It will be appreciated that system 201 overcomes one or more of the above-listed problems commonly associated with conventional air conditioning systems.

In the contemplated embodiment, system 201 includes a compressor 203, condenser 205, receiver 207, a first heat exchanger 209, a second heat exchanger 211 and an evaporator 213 all in fluid communication via tubes 215 and a fluid e.g. refrigerant.

In use, the fluid exiting the condenser 205 is collected in the receiver 207 so that a full column of liquid (of the fluid) enters the first heat exchanger 209. The first heat exchanger 209 uses fluid from the evaporator 213 mixed with fluid from the second heat exchanger 211 to absorb heat from the fluid from the receiver 207. The second heat exchanger 211 uses fluid from the first heat exchanger 209 to transfer heat to the fluid exiting therefrom after passing through a thermostatic expansion valve 217*a*. The fluid exiting the second heat exchanger 211 supplies a thermostatic expansion valve 217*a* and also the thermostatic expansion valve 217*b*, which in turn, supplies the evaporator 213.

A unique feature believed characteristic of the present application is that receiver 207 enables the first heat exchanger 209 to continuously function without interruptions in the fluid flow.

Another unique feature is the use of the first heat exchangers 209 and second heat exchanger 211 and additional thermostatic expansion valves 217 arranged to provide sub-cooled fluid (in liquid state) to the entry of the thermostatic expansion valve 217*b*.

Figure 3:
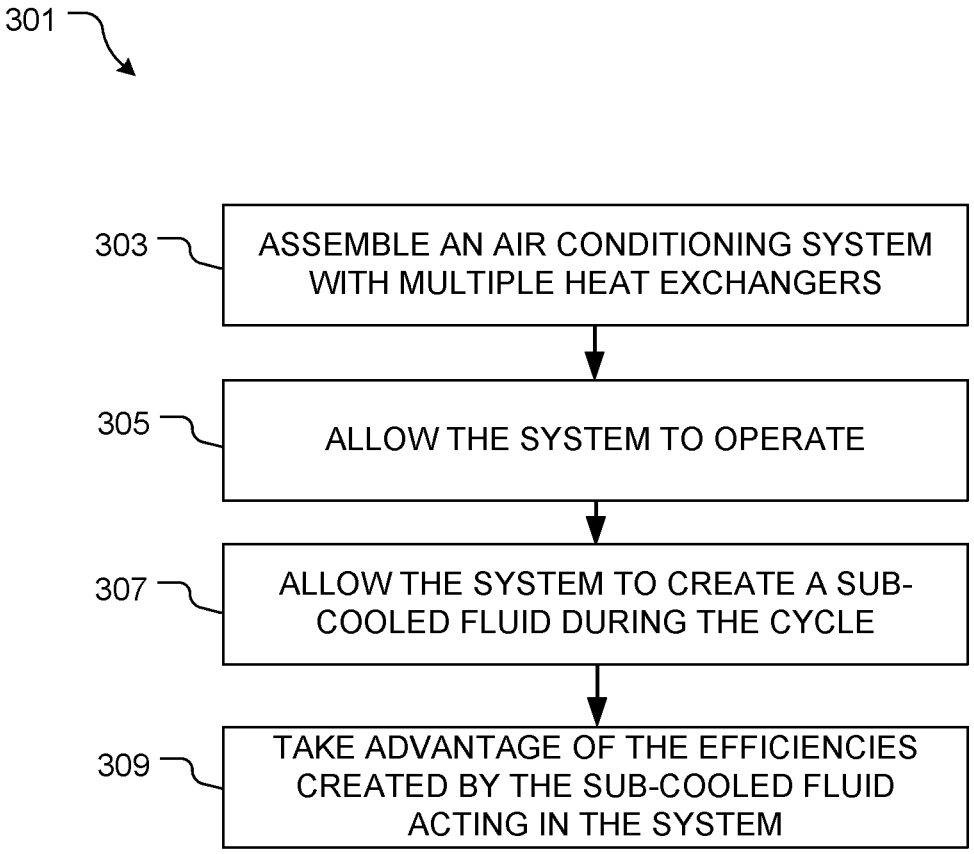
FIG. 3 is a flowchart of the preferred method of use of the system of FIG. 2.

Referring now to FIG. 3 the preferred method of use of the system 101 is depicted. Method 301 includes assembling an air conditioning system with multiple heat exchangers 303, allowing the system to operate 305, allowing the system to create a sub-cooled fluid during the cycle 307 and taking advantage of the efficiencies created by the sub-cooled fluid acting in the system 309.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. An efficient air conditioning system comprising:

a compressor;

a condenser positioned downstream of the compressor;

a receiver positioned downstream of the condenser;

a first heat exchanger positioned downstream of the receiver;

a second heat exchanger in communication with the first heat exchanger;

an evaporator in communication with the second heat exchanger and positioned downstream to the compressor;

a first thermostatic expansion valve positioned downstream of the second heat exchanger, the first thermostatic expansion valve is configured to direct fluid to the second heat exchanger; and a second thermostatic expansion valve positioned downstream of the second heat exchanger and upstream to the evaporator;

wherein both the second heat exchanger and the evaporator are in communication with the first heat exchanger.

2. The method of operating an air conditioner, comprising:

providing the system of claim 1;

assembling an air conditioning system with multiple heat exchangers; allowing the system to operate;

allowing the system to create a sub-cooled fluid during the cycle; and taking advantage of the efficiencies created by the sub-cooled fluid acting in the system.

* * * * *